US006250311B1

(12) United States Patent
Megna

(10) Patent No.: US 6,250,311 B1
(45) Date of Patent: Jun. 26, 2001

(54) METHOD OF APPLYING NAIL TIPS AND COMPOSITION

(75) Inventor: Michael Megna, Elk Grove, CA (US)

(73) Assignee: Backscrathers, Inc., Elk Grove, CA (US)

( * ) Notice: Subject to any disclaimer, the term of this patent is extended or adjusted under 35 U.S.C. 154(b) by 0 days.

(21) Appl. No.: 09/441,381

(22) Filed: Nov. 16, 1999

(51) Int. Cl.[7] ..... A45D 31/00
(52) U.S. Cl. ..... 132/200
(58) Field of Search ..... 132/200, 73

(56) References Cited

U.S. PATENT DOCUMENTS 4,627,453 * 12/1986 Isler ..... 132/73
4,954,190 * 9/1990 Taeckens ..... 132/73
5,044,384 * 9/1991 Hokama et al. ..... 132/200
5,127,414 * 7/1992 Mast et al. ..... 132/73
5,650,138 * 7/1997 Resler ..... 132/73
5,770,184 * 6/1998 Keller ..... 132/200

* cited by examiner

*Primary Examiner*—Todd E. Manahan
(74) *Attorney, Agent, or Firm*—Bernhard Kreten

(57) ABSTRACT

This patent specification discloses a method and compositions for applying an artificial finger nail tip to a natural finger nail. The method applies: (i) multiple brush-on coatings of a mixture of ethyl-2-cyanoacrylate, poly methyl methacrylate, and hydroquinone; (ii) several spray coatings of an aromatic dryer of ethyl acetate and aromatic amines; and (iii) at least one dip of glaze powder of poly (ethyl or ethyl/methyl) methacrylate, benzoyl peroxide, and silica as an opaquing agent. The preferred method is very easy to perform and does not require any use of polymer solvents or grinding or filing steps.

30 Claims, 5 Drawing Sheets

METHOD OF APPLYING NAIL TIPS AND COMPOSITION

FIELD OF THE INVENTION

The following invention relates generally to the application of an artificial nail tip to a finger nail. More specifically, this invention relates to methods of applying an artificial nail tip using cyanoacrylate, methacrylate, polymerization inhibitors and accelerants, and opaquing agents with a goal of reducing appreciably the time required for applying artificial nails.

Finger nail augmentation has become a growth industry relying on professional manicurists who practice time consuming methods. Curing times in nail processing have limited productivity.

BACKGROUND OF THE INVENTION

The use of cyanoacrylates and methacrylates to apply artificial nails to nail tips is not new. Various method have been developed to try to make the application of an artificial nail tip to a finger nail safer, easier, quicker and more economical and effective. They have been met with varying degrees of success, but still each suffer from differing types of problems or difficulties.

Some examples are disclosed in U.S. Pat. No. 5,824,180 to Mikuni, et al. The Mikuni patent discloses the prior art method of: (i) bonding an artificial nail tip to a finger nail with an adhesive; (ii) then applying a polymerizing resin to fill in the recessed part of the junction between the artificial nail tip and finger nail; (iii) then applying a polymerization accelerator; (iv) filing the resulting polymerized surface; and (v) coating the resulting nail surface with a lacquer or resin. This method requires the user to engage in the substantial, time-consuming effort of filing the polymerized resin surface. In addition, the Mikuni reference teaches that use of polymerization accelerators involves use of a solvent, which generates an odor that is unpleasant, and creates a troublesome working environment.

The Mikuni patent is directed toward trying to overcome these types of difficulties by use of photocurable adhesive. Photocurable adhesives have not proven satisfactory for a variety of reasons such as expense, lengthy curing times, and difficulty of controlling the timing of the curing process once the photocurable adhesive is exposed to light.

Other prior art methods are disclosed in U.S. Pat. No. 4,626,428 to Weisberg, et al. For example, the Weisberg, et al. patent describes the following prior art nail sculpting process: (i) cleaning, roughening and treating a finger nail with bromide; (ii) coating the nail with an adhesive such as cyanoacrylate ester, or a primer container methacrylic acid that binds the acrylic to the nail; (iii) wetting a brush with liquid methacrylate esters and a promoter, such as toluidine, to induce the decomposition of benzoyl peroxide applied in the next step; (iv) dipping the brush in powered methacrylate containing benzoyl peroxide to act as a polymerization catalyst, causing the methacrylate esters and powder to polymerize sufficiently to provide a dough-like substance; (v) brushing the dough on the nail; and (vi) after the dough has cured and hardened in place on the finger nail, sculpting the artificial nail surface on the surface of the hardened dough.

The Weisberg, et al. patent explains that this sculpting method is very difficult to perform. This sculpting method requires substantial dexterity, time, and experience to properly apply and sculpt the polymer dough, including substantial filing of the dough after it has cured. The sculpting method also ruins the brush since a substantial quantity of the dough often hardens in place on the brush.

The Weisberg, et al. patent describes other variants of the nail sculpting method in which the nail is first wetted and then dipped into a powder, rather than applying a dough, and then covered with other seal and fill coats. The Weisberg patent notes that the prior art methods do not induce sufficient cross-linking of the monomers in the various components, so the resulting nail is not sufficiently strong and durable.

The method of the Weisberg, et al. patent seeks to solve these problems by first applying a solvent to the brush prior to exposure of the brush to the liquid. The solvent helps prevent polymerization and bonding to the brush. In addition, the Weisberg method teaches dipping of the wetted nail in a resin powder of polymethacrylate esters and benzoyl peroxide, which is then again coated with liquid methacrylate ester monomers for curing and cross-linking of the liquids and powder in air. This prior art method, however, requires use of solvents of the type that prevent polymerization, and as noted by the Mikuni patent, these types of solvents present significant working environment issues.

U.S. Pat. No. 4,687,827 to Russo also discloses a method of applying nail tips by use of polymerization accelerators to achieve shortened curing time. The Russo patent also discloses extension of shelf life of cyanoacrylate adhesive, prior to application of the adhesive, by addition of polymerization inhibitors such as hydroquinone. The Russo patent also suggests inclusion of silica to build up the nail surface. Like the Weisberg patent, however, the Russo patent does so in the context of teaching use of pre-wetting solvent to keep the liquid adhesive cyanoacrylates from curing too soon.

U.S. Pat. No. 4,844,102 to Repensek discloses use of a dryer sprayed on cyanoacrylate to encourage faster polymerization during application of an artificial finger nail tip. The Repensek method, however, also involves use of a polymer solvent (and the attendant problems and issues noted above). In the Repensek method, the solvent is applied after application of the applied monomers and polymers in order to dissolve, spread, and shape them and, by the endothermic evaporation of the solvent, reduce the amount of heat otherwise imparted to the finger nail by the exothermic reaction of the polymerizing components.

U.S. Pat. No. 5,770,184 to Keller teaches the application of a nail tip by applying one or (optionally when used to apply a prefabricated nail) two coats of cyanoacrylate adhesive followed by immediate application of a nail tip. The Keller patent teaches that the user should then wait for the cyanoacrylate adhesive to dry and secure the nail tip to the finger nail, and then add additional coats of cyanoacrylate followed by spraying the cyanoacrylate coats with a mixture of pink acrylic powder and sodium bicarbonate to accelerate polymerization. The Keller patent also suggests use of benzoyl peroxide in the powder, to accelerate polymerization, and the use of opaquing agents such as silicon dioxide. The Keller method requires a substantial amount of time waiting for the first and, if applied, second coat of cyanoacrylate adhesive to dry under the applied vinyl nail tip. The applicant also believes that the nail resulting from the Keller patent is not as strong as is desirable.

SUMMARY OF THE INVENTION

The applicant has invented a method of applying an artificial nail to a finger nail and composition. One hallmark involves reducing the time required to install artificial nails. The method includes the steps of applying a first base resin coat of cyanoacrylate to the finger nail and quickly curing the base resin with a dryer, and then applying the same base resin for application of the artificial nail over the first coating. Next, apply one coat of finish resin to the exposed artificial nail surface, and dip the finger nail and nail tip into a powder resin mixture of poly methyl methacrylate and a polymerization catalyst. Then apply a further coat of finish resin to the finger nail and nail tip. Finally, spray the finger nail and nail tip with an aromatic dryer to accelerate polymerization.

Preferably, the nail tip is secured in place without use of any solvents such as those for dissolving polymers, and without the need for any grinding or filing and with only a relatively light buffing of the nail. Preferably, the base resin mixture includes a polymerization inhibitor, and the powder resin mixture includes both a polymerization catalyst and an opaquing and filling agent such as silica.

Most preferably, the polymerization dryer comprises ethyl acetate and aromatic amines.

Although this is a brief summary of the invention, it is to be understood that the scope of the invention is determined by reference to the accompanying claims and not by whether a given embodiment includes the features briefly stated herein.

OBJECTS OF THE INVENTION

It is an object of the present invention to provide an easy, quick, and relatively safe and reliable method of applying an artificial nail to a finger nail and composition.

It is an advantage of the present invention that it is very economical because artificial nails can be installed in a fraction of the time heretofore experienced.

It is yet another advantage of the present invention that it provides a nail tip that is very securely mounted on the finger nail.

It is a further advantage of the present invention that it can secure an aesthetically pleasing nail tip to a finger nail without use of harmful solvents and without the need for grinding or filing of the natural nail tip or other components applied with the method.

A still further advantage of the present invention is that it utilizes relatively readily available and economical components and compositions.

Yet another advantage is that the present invention can provide components having a long shelf life and yet allows the nail tip to be secured in position on the finger nail quickly and without a long polymerization or curing time.

An additional advantage is that the present method can include use of opaquing and filling agents that makes the resulting nail appear more natural while also providing a more effective and quick method of filling in any cracks, depressions, or joints when finishing the nail and nail tip.

These and other objects will be made manifest when considering the following detailed specification when taken in conjunction with the appended drawing figures.

DESCRIPTION OF PREFERRED EMBODIMENTS

Figure 1:
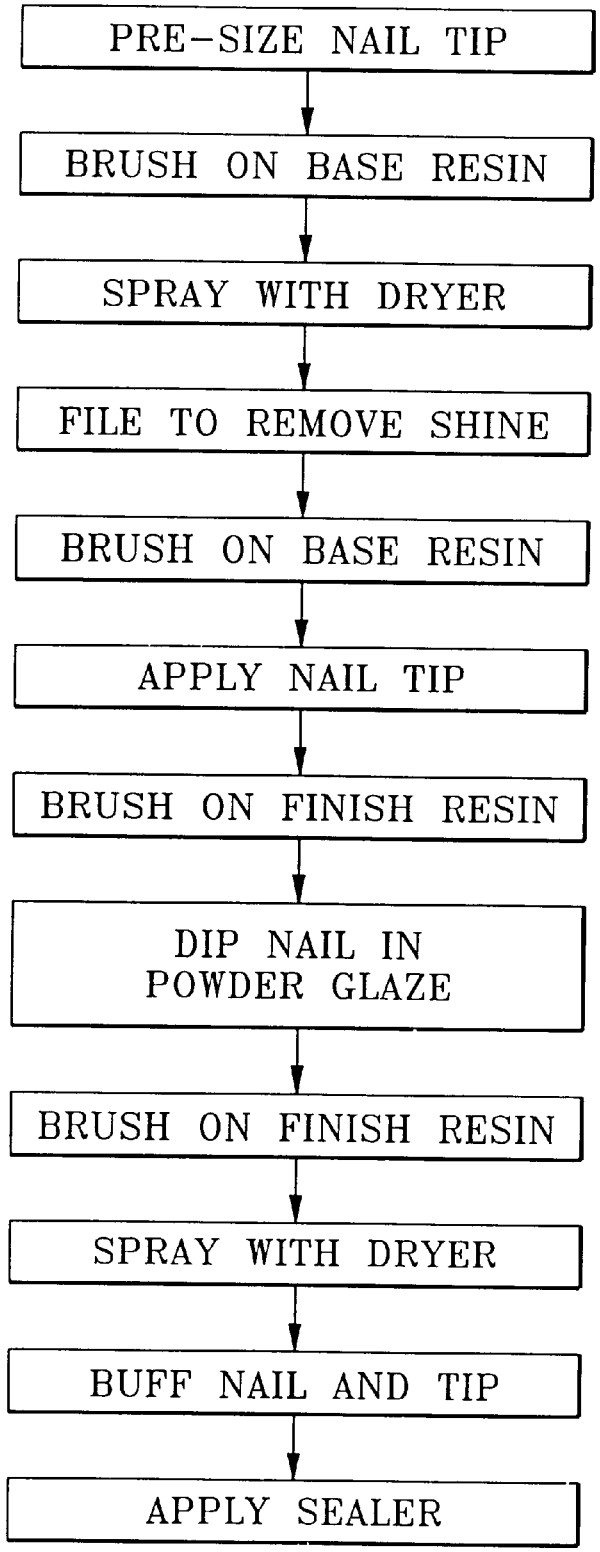
FIG. 1 is a chart showing the main steps and order of the steps in the preferred method.
Figure 2:
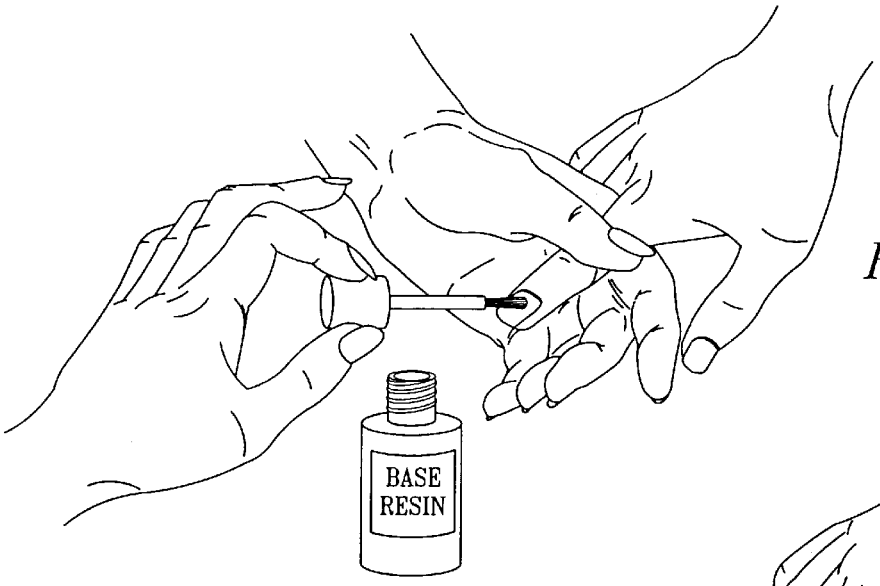
FIG. 2 is a perspective view showing applying a base resin.
Figure 3:
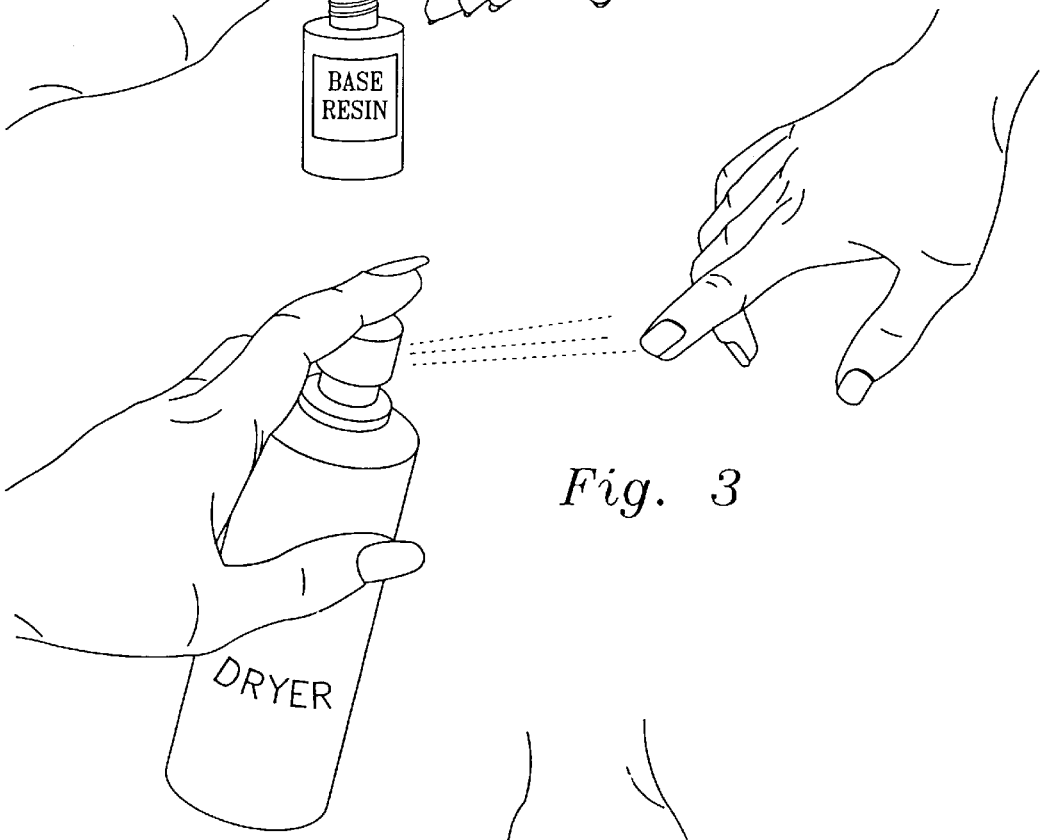
FIG. 3 is a perspective view showing applying a dryer.
Figure 4:
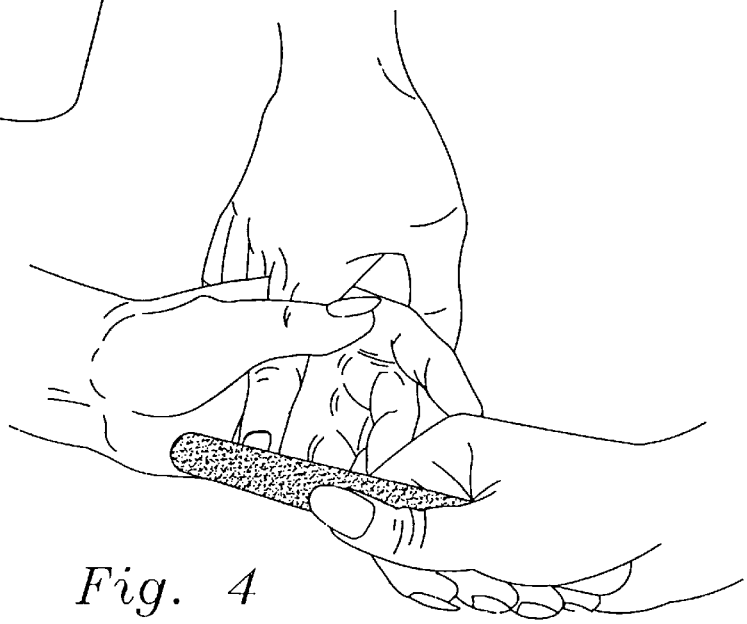
FIG. 4 is a perspective view showing filing the nail.
Figure 5:
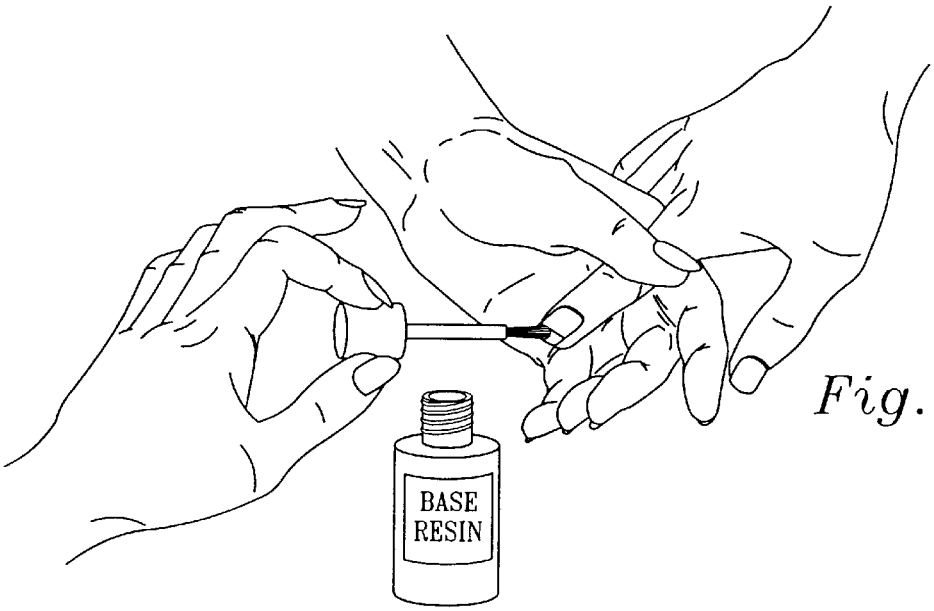
FIG. 5 is a perspective view showing applying the base resin.
Figure 6:
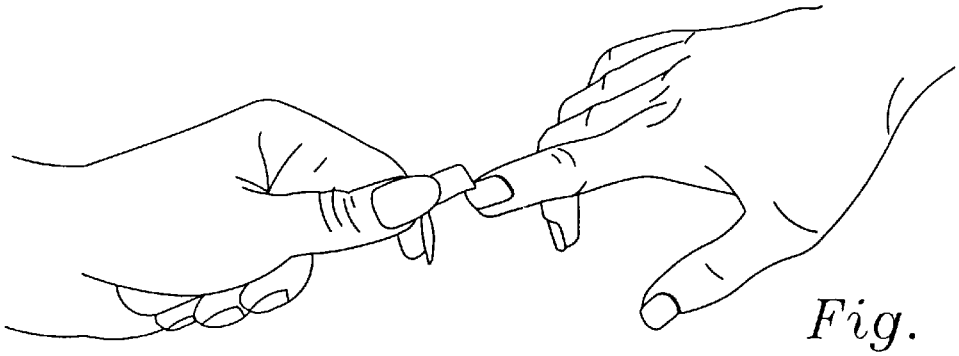
FIG. 6 is a perspective view showing applying the nail.

Referring now to FIG. 1, the applicant's preferred embodiment consists of twelve easy steps, with no mandatory nail brushing, no mandatory nail filing, and no mandatory use of polymer solvents. Before commencing the twelve steps of FIG. 1, however, the applicant generally prefers to engage in certain limited nail preparation steps as follows:

1. Remove any pre-existing nail polish from the finger nail with a nail polish stripper in a fashion well known to those of skill in the art.
2. Cleanse the hands, including the finger nails, with a hygienic soap; rinse the hands and nails with warm water, and let dry thoroughly. It is important that this cleaning step should not involve use of any primers or dehydrators.
3. Push back the cuticles on each finger nail with a rubber tipped cuticle pusher such as are commonly available on the market.
4. Trim and shape each finger nail, leaving approximately 1/16" of free outer edge on the exposed end of the finger nail. Smooth the free edge using a file, preferably of 240 grit (medium grit).
5. Remove any shine from the natural nail with a file, preferably of 600 grit (fine grit). Wipe away any nail dust.

The preferred method shown in FIG. 1 then proceeds immediately thereafter as follows:

1. Size the artificial nail tip to the desirable length.
2. Using a nail brush (such as those that are commonly available in the trade and are provided commonly inside a bottle downwardly extending from the bottle cap), brush a first coating of a base adhesive resin mixture smoothly onto the entire natural nail surface. Preferably, the brush is included in the cap of the bottle for the base adhesive resin mixture.
3. Spray the entire exposed part of the nail, including the nail sides, with an aromatic dryer (to accelerate polymerization) from 4–5" away from the nail.

This step causes the base resin mixture to polymerize or cure and harden.

Figure 7:
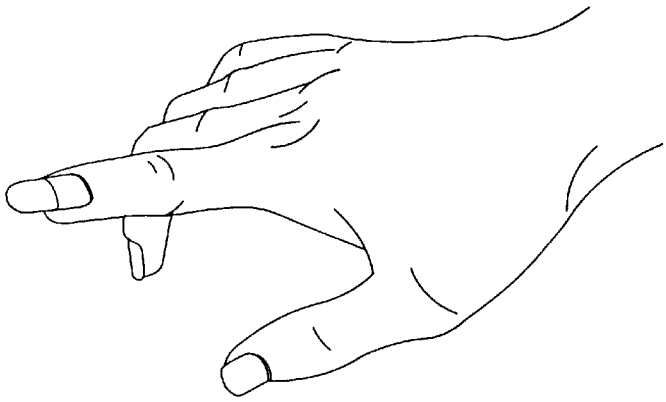
FIG. 7 is a perspective view showing the nail applied.
Figure 8:
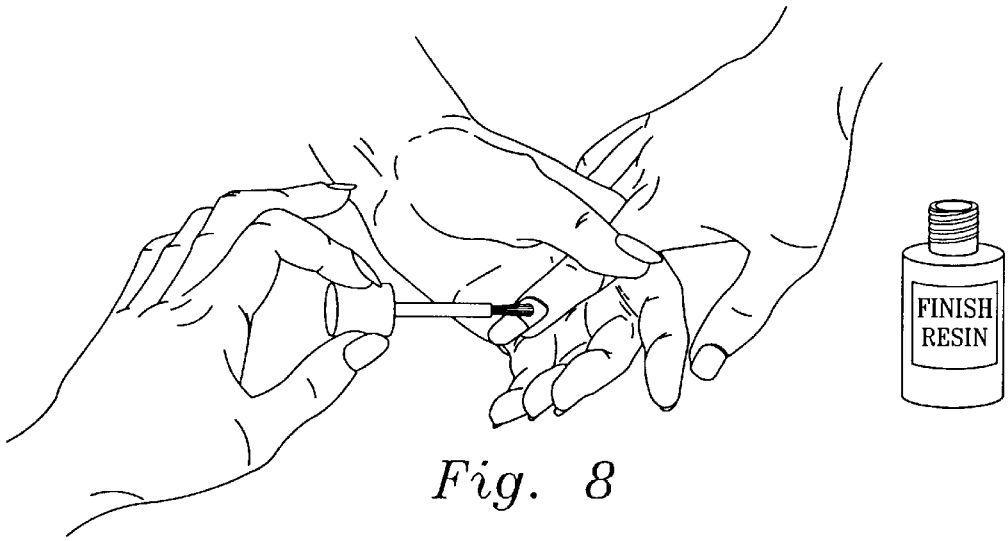
FIG. 8 is a perspective view showing applying a finish resin.
Figure 9:
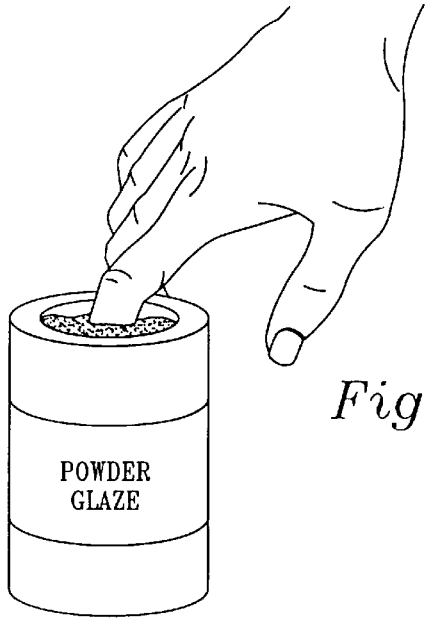
FIG. 9 is a perspective view showing dipping the nail in a powder glaze.
Figure 10:
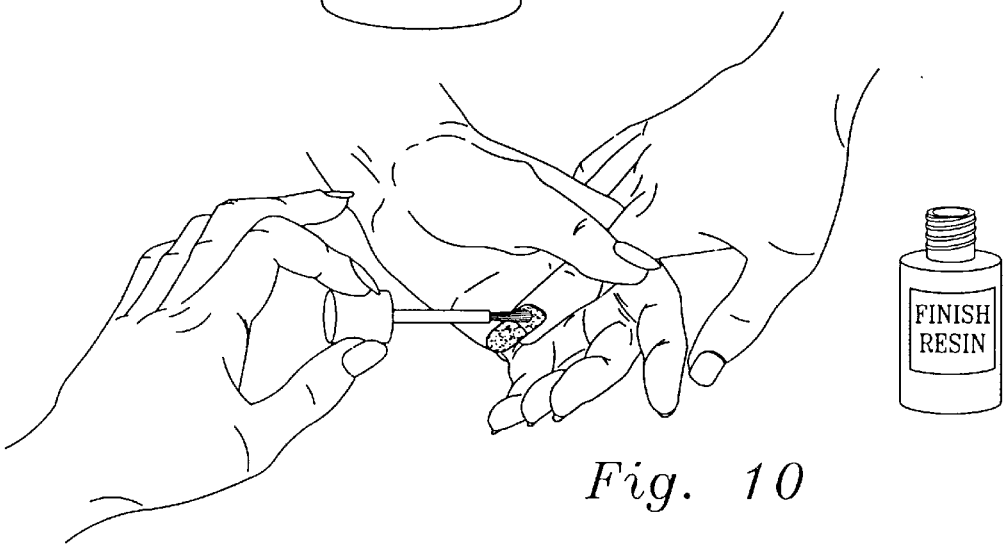
FIG. 10 is a perspective view showing applying the finish resin.
Figure 11:
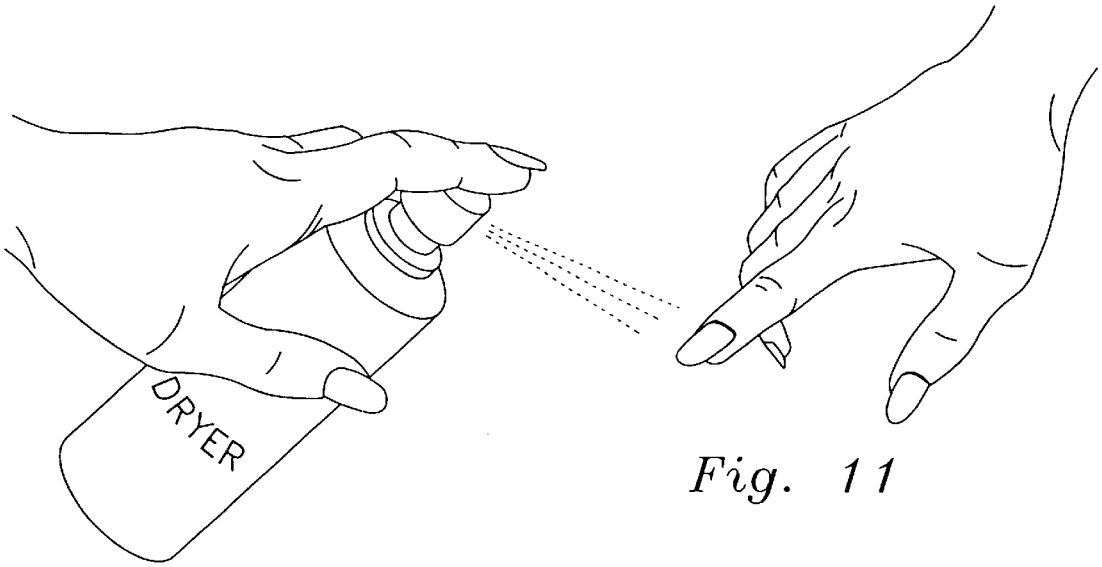
FIG. 11 is a perspective view showing applying the dryer.
Figure 12:
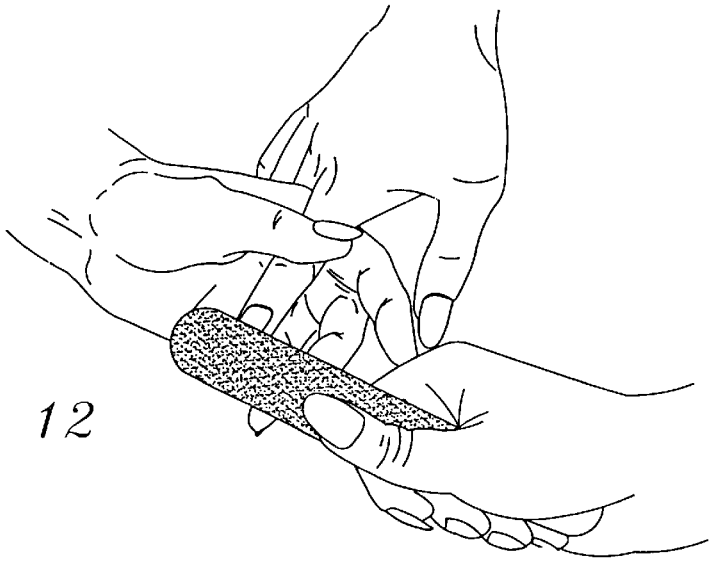
FIG. 12 is a perspective view showing filing the nail.
Figure 13:
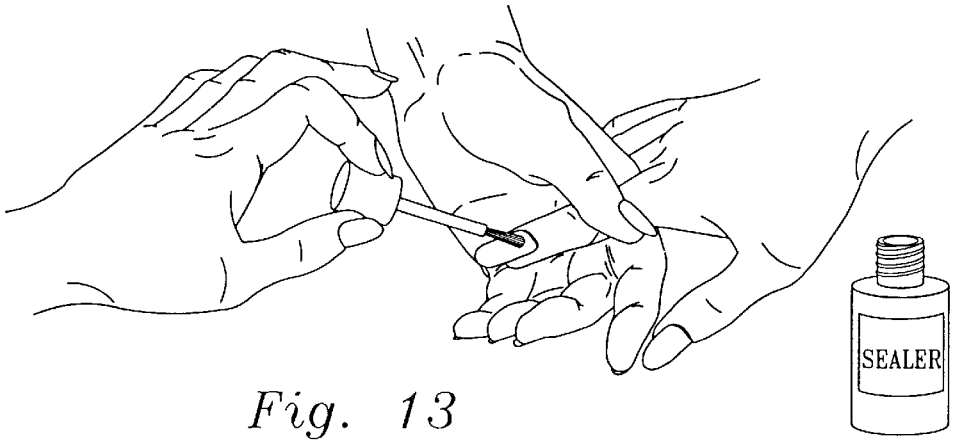
FIG. 13 is a perspective view showing applying the sealer.

4. Using preferably a 240 (medium) grit file, remove the surface shine from the portion of the finger nail on which the artificial nail is to be mounted. The artificial nail should preferably be mounted on at least 1/16" of natural nail free edge as per FIG. 7. Remove any filing dust.
5. Brush a second coating of the base adhesive resin mixture onto the portion of the outer nail surface on which the artificial nail tip is to be mounted (at least 1/16" of the free edge and away from the cuticle).
6. Apply the artificial nail tip to the area on the finger nail coated with the second coating of the base adhesive resin mixture. The preferred nail tip is the Nouveau Tip available from Backscratchers®.

7. Brush a first coating of the finish adhesive resin mixture over the entire artificial nail tip and any exposed underlying portion of the finger nail, but not on the ⅛" portion extending from the cuticle. As noted above, that portion of the nail should not be coated or covered and should remain exposed to the open air.
8. Dip the finger nail/artificial nail tip into a container of a powder glaze resin mixture. Remove the finger nail/artificial nail tip from the container and lightly tap off any excess powder glaze resin mixture back into the container or onto a piece of paper for later return of the unused powder resin glaze mixture back into its container.
9. Brush a second coating of the finish adhesive resin mixture over the entire artificial nail tip and any exposed underlying portion of the finger nail, but not on the 1/16" portion of the finger nail extending from the cuticle. At this point, the applicant prefers to wipe any base or powder glaze resin off of the brush and return the brush to the resin container.
10. Spray the entire exposed part of the finger nail and nail tip with an aromatic dryer from 4–5" away from the nail.
11. Buff the finger nail and tip to smooth out the exposed nail and nail tip surface. Using preferably 600 grit (fine), then white and gray buffers. The applicant prefers to buff the nail tip in three successive stages using first the 600, then the white, then the gray. The applicant also prefers to buff around the cuticles to make sure to remove any resin that has cured in that area, to prevent early lifting of the nail tip from the finger nail.
12. Optionally, the operator may then apply, to the exposed portions of the nail tip only, a sealer such as Extreme Glaze Sealer™ available from Backscratchers®. Optionally, the preferred method may also include applying a polish or a cuticle treatment to the cuticle and underside of the nail, such as Nail Radiance® also available from Backscratchers®.

In the applicant's preferred method, the base adhesive resin mixture consists of 70–100% of ethyl cyanoacrylate, 10–30% poly methyl methacrylate, and 0–1% hydroquinone. The aromatic dryer consists of 80–100% ethyl acetate and 0–20% aromatic amines. The finish adhesive resin mixture consists of 70–100% of ethyl cyanoacrylate, 10–30% of poly methyl methacrylate, and 0–1% of hydroquinone. The powder glaze mixture consists of 90–100% poly (ethyl or ethyl/methyl) methacrylate, 0–5% benzoyl peroxide, and 0–5% silica. The silica serves as an opaquing agent, to render the resulting nail more natural in appearance, and as a filler, to aid in filling any cracks or gaps in the nail and nail tip surface. The powder glaze mixture has a white to pink (blush) hue.

The resulting nail/nail tip is very strong and natural in appearance. The nail tip will often remain in position on the finger nail for at least four weeks, until the finger nail grows so far that the artificial nail grows away from the cuticle.

The above method can be varied depending on the circumstances. For example, the operator may apply additional coatings of the base resin and, optionally, additional dips of the powder glaze may be interspersed between the additional coatings of the finish resin, in order to build up the artificial nail surface or to fill in cracks or gaps on the nail/nail tip surface. In addition, the operator may also spray repeated, additional coats as desired to enhance polymerization of the coatings and intermittent dips. In other words, steps seven (7) through ten (10) above may be repeated a number of times if desired. If necessary, in these circumstances (although generally not preferred and not necessary to securely mounted nail tip in a natural-looking fashion on a finger nail), filing and/or buffing steps then may be added prior to a final buff in order to smooth out and shape the nail surface. While the spray shown is an aerosol, a pump spray could be used.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method of applying an artificial nail tip to a finger nail, the method comprising the steps of:

A applying to the surface of the finger nail a first coating of a base resin mixture of cyanoacrylate and a methacrylate;

B spraying the finger nail with a polymerizing dryer, whereby the base resin mixture polymerizes and hardens;

C applying over the first coating a second coating of the base resin mixture just where the artificial nail tip is to be applied;

D applying the artificial nail tip over the second coating of the base resin mixture;

E applying over the artificial nail tip a coating of a finish resin mixture;

F applying to the exposed surface of the nail tip a powder mixture of a poly methyl methacrylate and a polymerization catalyst;

G applying to the finger nail and nail tip a second coating of the finish resin mixture; and H spraying the finger nail and nail tip with the polymerizing dryer.

2. The method of claim 1 wherein the nail tip is securely mounted on the finger nail without use of a solvent of the type for dissolving polymerized methacrylate.

3. The method of claim 2 wherein the powder mixture also includes a polymerization catalyst and an opaquing agent.

4. The method of claim 2 wherein the nail tip is mounted on the natural finger nail without grinding or filing of the natural finger nail, the nail tip, or the applied resin or powder mixtures.

5. The method of claim 2 wherein the base resin mixture also includes a polymerization inhibitor to inhibit the polymerization of the cyanoacrylate and the methacrylate.

6. The method of claim 5 wherein the polymerization inhibitor comprises hydroquinone.

7. The method of claim 6 wherein the polymerizing dryer comprises ethyl acetate and aromatic amines.

8. The method of claim 6 wherein the powder mixture also includes a polymerization catalyst and an opaquing agent.

9. The method of claim 8 wherein the polymerization catalyst comprises benzoyl peroxide and the opaquing agent includes silica.

10. The method of claim 9 wherein the polymerizing dryer comprises ethyl acetate and aromatic amines.

11. The method of claim 10 wherein the nail tip is mounted on the natural finger nail without grinding or filing of the natural finger nail, the nail tip, or the applied resin or powder mixtures.

12. The method of claim 8 wherein the polymerizing dryer comprises ethyl acetate and aromatic amines.

13. The method of claim 12 wherein the nail tip is mounted on the natural finger nail without grinding or filing of the natural finger nail, the nail tip, or the applied resin or powder mixtures.

14. The method of claim 5 wherein the powder mixture also includes a polymerization catalyst and an opaquing agent.

15. The method of claim 6 wherein the nail tip is mounted on the natural finger nail without grinding or filing of the natural finger nail, the nail tip, or the applied resin or powder mixtures.

16. The method of claim 1 wherein the base resin mixture also includes a polymerization inhibitor to inhibit the polymerization of the cyanoacrylate and methacrylate.

17. The method of claim 16 wherein the powder mixture also includes a polymerization catalyst and an opaquing agent.

18. The method of claim 3 wherein the polymerizing dryer comprises ethyl acetate and aromatic amines.

19. The method of claim 16 wherein the polymerization inhibitor comprises hydroquinone.

20. The method of claim 19 wherein the powder mixture also includes a polymerization catalyst and an opaquing agent.

21. The method of claim 20 wherein the polymerizing dryer comprises ethyl acetate and aromatic amines.

22. The method of claim 21 wherein the nail tip is mounted on the natural finger nail without grinding or filing of the natural finger nail, the nail tip, or the applied resin or powder mixtures.

23. The method of claim 1 wherein the powder mixture also includes a polymerization catalyst and an opaquing agent.

24. The method of claim 23 wherein the polymerizing dryer comprises ethyl acetate and aromatic amines.

25. The method of claim 23 wherein the polymerization catalyst comprises benzoyl peroxide and the opaquing agent includes silica.

26. The method of claim 25 wherein the nail tip is mounted on the natural finger nail without grinding or filing of the natural finger nail, the nail tip, or the applied resin or powder mixtures.

27. The method of claim 1 wherein the polymerizing dryer comprises ethyl acetate and aromatic amines.

28. The method of claim 27 wherein the nail tip is mounted on the natural finger nail without grinding or filing of the natural finger nail, the nail tip, or the applied resin or powder mixtures.

29. The method of claim 1 wherein the nail tip is mounted on the natural finger nail without grinding or filing of the natural finger nail, the nail tip, or the applied resin or powder mixtures.

30. A method of applying an artificial nail tip to a finger nail, the method comprising the steps of:

A applying to the surface of the finger nail a first coating of a base resin mixture of cyanoacrylate and a methacrylate;

B spraying the finger nail with a polymerizing dryer, whereby the base resin mixture polymerizes and hardens;

C applying the artificial nail tip;

D applying over the artificial nail tip a coating of a finish resin mixture;

E applying to the exposed surface of the nail tip a powder mixture of a poly methyl methacrylate and a polymerization catalyst;

F spraying the finger nail and nail tip with the polymerizing dryer.

* * * * *